United States Patent [19]

Folsom et al.

[11] 4,257,310

[45] Mar. 24, 1981

[54] AMMUNITION FEEDING MECHANISM FOR A GUN

[75] Inventors: Lawrence R. Folsom, Schenectady, N.Y.; Victor R. Gardy, Shelburne; August J. Haberstroh, Highgate, both of Vt.

[73] Assignee: General Electric Company, Burlington, Vt.

[21] Appl. No.: 32,587

[22] Filed: Apr. 23, 1979

Related U.S. Application Data

[62] Division of Ser. No. 533,160, Dec. 16, 1974, which is a division of Ser. No. 403,121, Oct. 3, 1973, Pat. No. 3,915,058.

[51] Int. Cl.[3] ..... F41D 10/06

[52] U.S. Cl. ..... 89/33 CA; 42/25

[58] Field of Search ..... 89/33 BA, 33 BC, 33 CA

[56] References Cited

U.S. PATENT DOCUMENTS 3,869,960 3/1975 Clark ..... 89/33 CA

*Primary Examiner*—Stephen C. Bentley

*Attorney, Agent, or Firm*—Bailin L. Kuch

[57] ABSTRACT

A single barrel gun has a rotary operating mechanism which is symmetrical about the longitudinal axis of the gun barrel and a feeder for ammunition.

4 Claims, 13 Drawing Figures

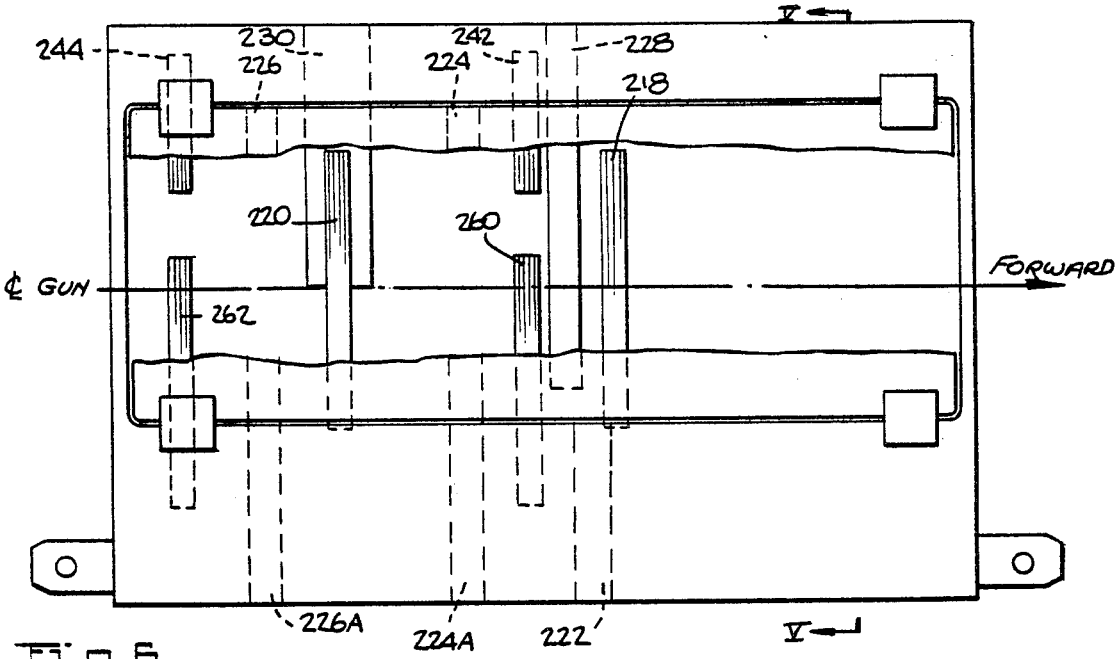
Fig. 6.
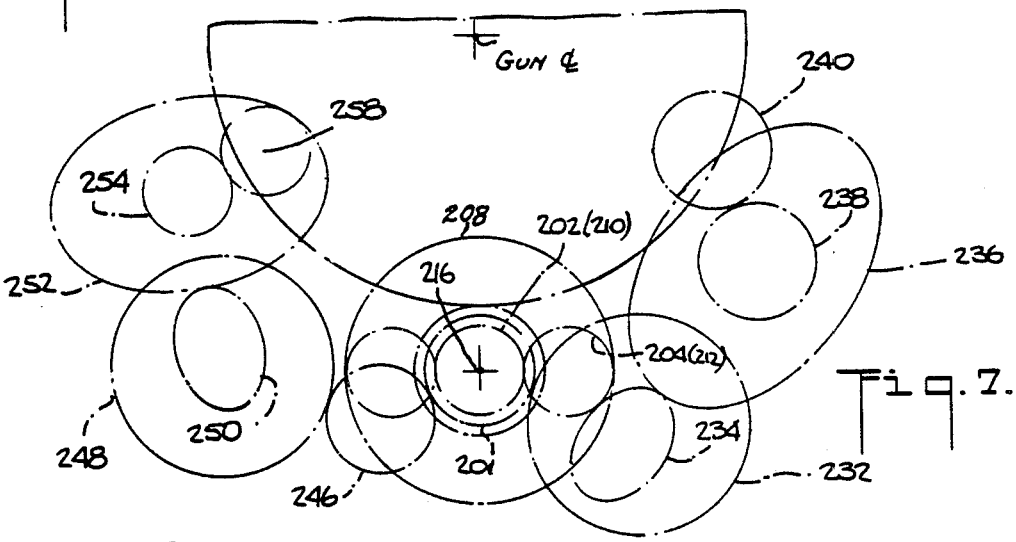
Fig. 7.
Fig. 8.
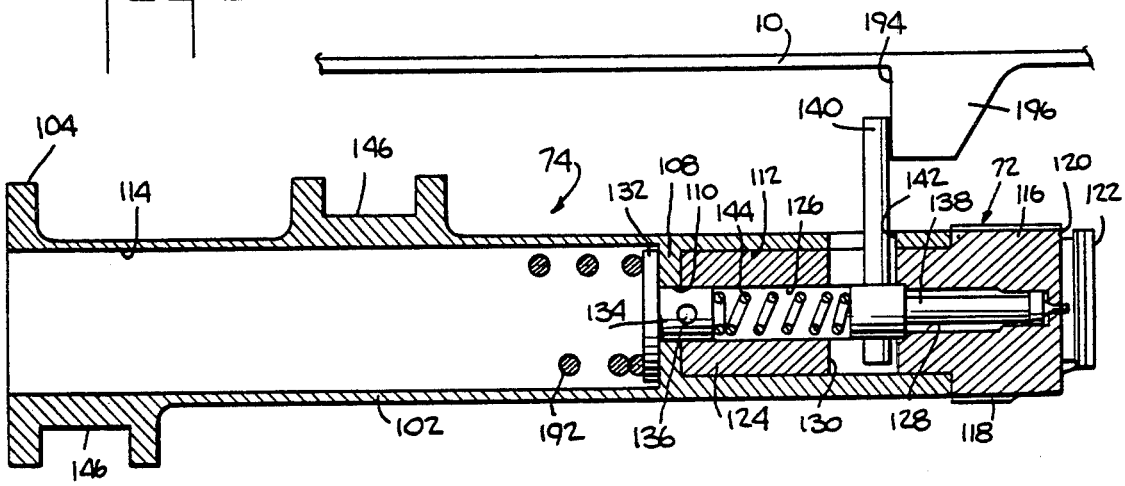

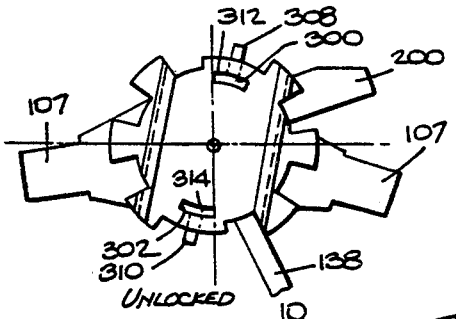
Fig. 11B.
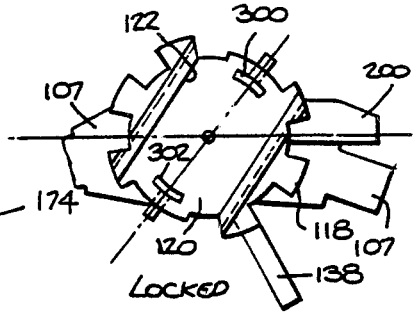
Fig. 10B.
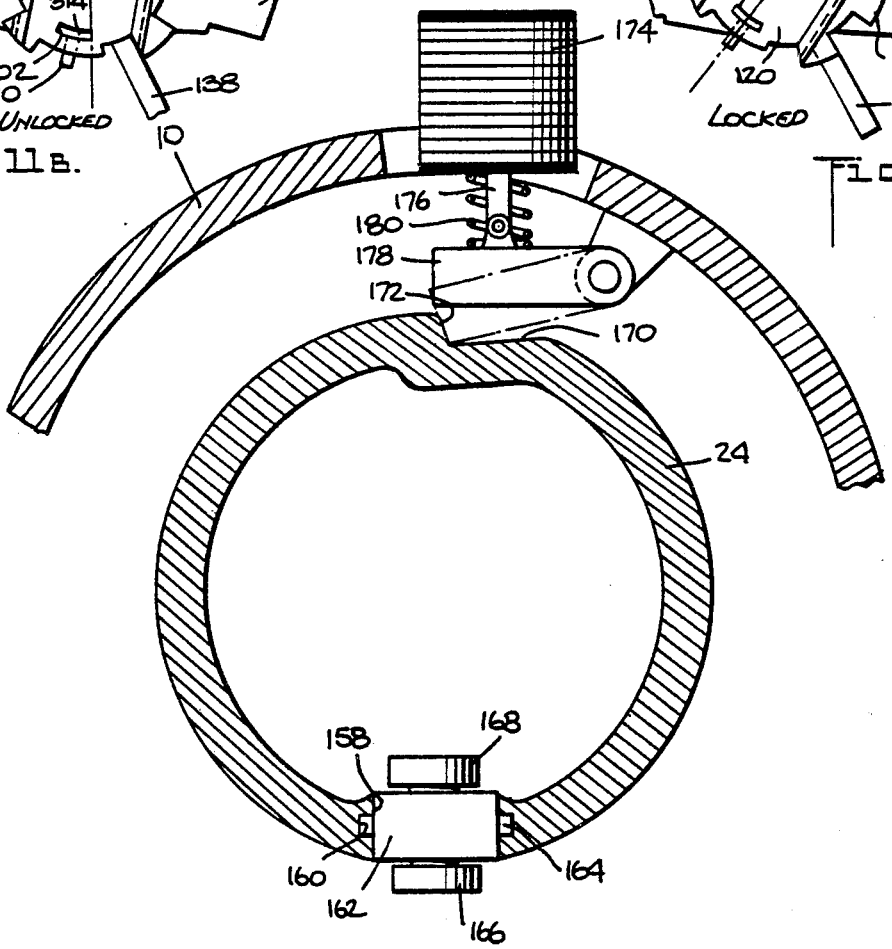
Fig. 9.
Fig. 11A.
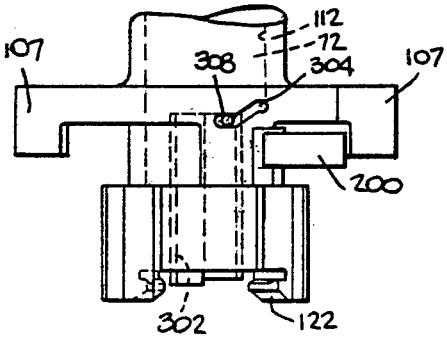
Fig. 10A.
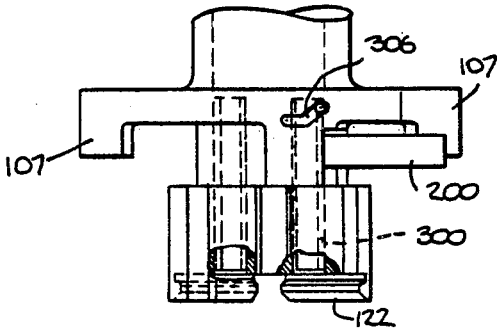

AMMUNITION FEEDING MECHANISM FOR A GUN

This application is a division of Ser. No. 533,160, filed Dec. 16, 1974, which was a division of Ser. No. 403,121, filed Oct. 3, 1973, now U.S. Pat. No. 3,915,058.

BACKGROUND OF THE INVENTION

1. Field of the Invention

This invention relates to operating mechanisms and feeders for single barrel guns, particularly to a rotary operating mechanism which may be recoil driven.

2. Prior Art

In the conventional, recoil operated, high rate of fire, single barrel gun, the major portion of the reaction to the forward motion of the projectile and propellant gas is transmitted by the recoiling barrel in a single, short time period impact to the bolt. The bolt is thrown to the rear of the gun and then bounces forward to battery, in passing stripping a round from the feed mechanism. The position and time coordinates of the moving masses are not positively controlled. Much of the reaction energy is transferred to the gun housing or the receiver and thence to the mount. This reaction energy may be disasterous to a vehicle which cannot absorb high impact forces. The short time period, high impact loads require heavy structures to survive such loading.

Typically also, the feeder of such a gun is operated intermittently, and is driven only during a short portion of the gun cycle, thereby putting high peak loads on the ammunition supply.

Possible approaches to solutions have been indicated by the prior art. An externally powered rotary operating mechanism is shown by R. J. Gatling in U.S. Pat. No. 125,563 issued Apr. 9, 1877. More modern, conventional rotary operating mechanism are shown, for example, by H. McC. Otto in U.S. Pat. No. 2,849,921 issued Sept. 2, 1958; R. E. Chiabrandy in U.S. Pat. No. 3,407,701 issued Oct. 29, 1968; and R. E. Chiabrandy et al in U.S. Pat. No. 3,380,343 issued Apr. 30, 1968. A gas powered rotary operating mechanism is shown by R. F. Hudson in U.S. Pat. No. 1,786,207 issued Dec. 23, 1930. A recoil operated feeder is shown in "The Machine Gun" by G. M. Chinn, Vol. IV, page 245, Department of the Navy, 1955.

SUMMARY OF THE INVENTION

Accordingly, it is an object of this invention to provide an operating mechanism for a recoil operated, high rate of fire, single barrel gun which provides:

a. Positive time and position control of all moving parts;
b. Positive control of energy transfers from moving masses to storage springs, and return;
c. Low peak loads on major moving parts, and low energy losses;
d. Substantially constant velocity of rounds drawn from the ammunition supply;
f. In general, a lightweight, simple, well balanced, highly reliable, recoil operated, high rate of fire, single barrel gun.

A feature of this invention is the provision of a gun having a single barrel and a rotary operating mechanism which is symmetrical about the longitudinal axis of the gun barrel.

BRIEF DESCRIPTION OF THE DRAWING

These and other objects, features and advantages of the drawing will be apparent from the following specification thereof taken in conjunction with the accompanying drawing in which:

FIG. 6 is a plan detail view of a portion of the embodiment of FIG. 1, taken along plane VI—VI particularly showing the feeder mechanism;

FIG. 7 is a transverse view in cross-section of the embodiment of FIG. 1, taken along plane VII—VII, particularly showing the gear train of the feeder mechanism;

FIG. 8 is a longitudinal view in cross-section of the gun bolt of FIG. 1, taken along a plane through the gun barrel longitudinal axis, particularly showing the firing pin mechanism;

FIG. 9 is a transverse view in cross-section of the embodiment of FIG. 1, taken along a plane IX—IX, looking aft, particularly showing the sear;

FIGS. 10A and 10B are longitudinal and transverse views respectively of a modified embodiment of the head of the gun bolt in the locked position; and FIGS. 11A and 11B are longitudinal and transverse views respectively of the embodiment of FIG. 10A in the unlocked position.

DESCRIPTION OF THE PREFERRED EMBODIMENT

Figure 1:
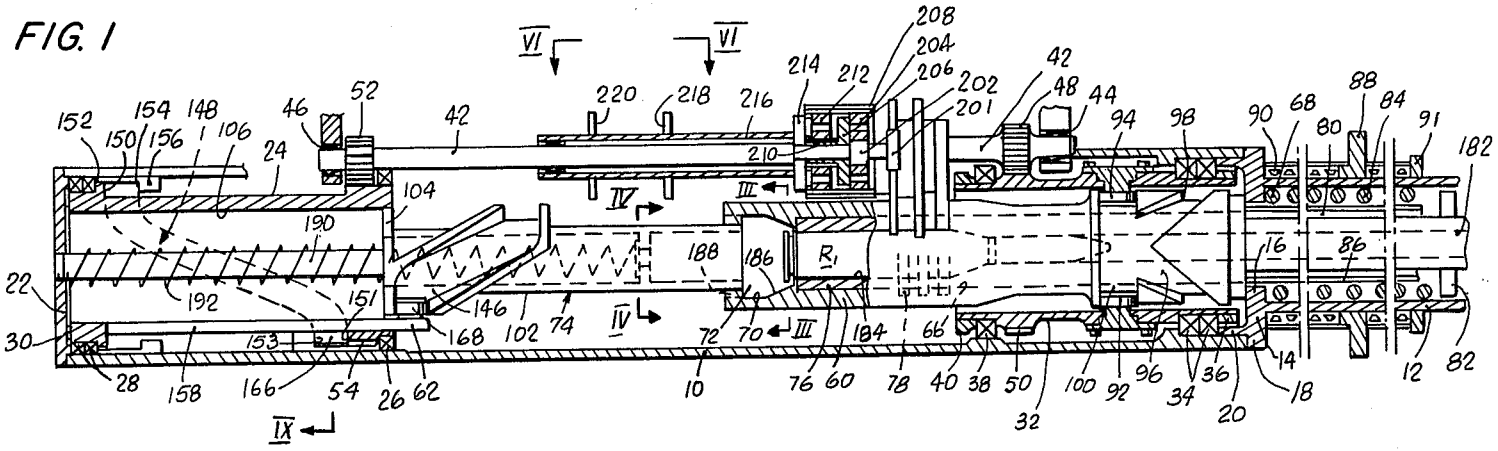
FIG. 1 is a longitudinal view in cross-section of a gun embodying this invention; taken along a plane through the gun barrel longitudinal axis.

The embodiment of the invention shown in FIG. 1 comprises a single barrel, recoil driven, rotary operated machine gun.

The gun comprises a main housing 10 of substantially tubular shape, to which is fixed a forward housing 12 which is also of tubular shape. The aft end of the forward housing includes an annular ring 14 providing an inner annulus 16, and outer annulus 18, and an aft annulus 20. A back plate 22 is fixed to the aft end of the housing 10.

An aft rotor 24 of generally tubular shape is journalled for rotation about the gun longitudinal axis within the housing 10 by a forward radial bearing 26 and by a pair of aft thrust bearings 28 held by a bearing retainer ring 30.

A forward rotor 32 of generally tubular shape is journalled for rotation about the gun longitudinal axis within the housings 10 by a pair of forward thrust bearings 34 held by a retainer ring 36, and by an aft radial bearing 38 held by a retainer ring 40.

A connecting shaft 42 is journalled, for rotation parallel to the gun longitudinal axis, to the housing 10 by a forward radial bearing 44 and an aft radial bearing 46. The shaft includes a forward gear annulus 48 meshed with a gear annulus 50 on the forward rotor 32, and an aft gear annulus 52 meshed with a gear annulus 54 on the aft rotor. The shaft thus couples the front and rear rotors for concurrent rotation, and as will be described later, drives a feeder system and serves as a torsion-spring self starter.

A barrel extension 60 is disposed within the housing 10 and is journalled for reciprocation by slides riding in tracks 64 in the housing. The barrel extension includes a forward bore 66 for receiving the gun barrel 68 and an aft bore 70 for receiving the head 72 of the gun bolt 74. The aft end 76 of the gun barrel is secured in the forward bore 66 by means of a plurality of interrupted threads 78. Alternatively, lugs and a latch may be utilized. The forward portion 80 of the gun barrel extends into the forward housing 12. An annular spring stop 82 is fixed to the forward end of the gun barrel. A barrel return spring 84 is disposed about the forward end of the gun barrel and spaced therefrom by a sleeve 86, within the forward housing 12, between the spring stop 82 and the inner annulus 16. A trunnion ring 88 is disposed on the forward housing 12 and journalled for reciprocation thereon in suitable tracks, not shown, and restrained by suitable buffer springs 90 fore and aft of the ring which are constrained between the outer annulus 18 and a lock ring 91 fixed forwardly on the forward housing.

The forward rotor 32 has two diametrically opposed cam rollers 92 and 94, which respectively ride in two overlapping helical cam tracks 96 and 98 in the barrel extension 60. An annular cam track 100 overlaps the two helical tracks.

The gun bolt 74 includes the gun bolt head 72, and a substantially tubular body 102 terminating in an aft guide disc 104. The aft guide disc slides within the bore 106 of the aft rotor 24. The tubular body has a pair of slides 107 riding in the tracks 64, a transverse web 108, with a longitudinal bore 110, separating a forward bore 112 from an aft bore 114. The head 72 has a forward portion 116 having a plurality of radially projecting locking lugs 118, a bolt face 120, a pair of diametrically spaced apart extractor lugs 122, and an aft portion 124 disposed within the bore 112 having a longitudinal aft bore 126, a longitudinal forward stepped bore 128 and a transverse slot 130. A disc 132 is disposed in the bore 114 and has a stem 134 passing through the bore 110 into the bore 126 of the head. A pin 136 passes through transverse bores in the stem and body and through a slot in the head to fix these parts together while permitting some relative rotation of the head to the body. A firing pin 138 is disposed in the bore 128 and has a transverse actuating arm 140 fixed thereto and passing outwardly through the slot 130 and a slot 142 in the body 114. A helical firing pin spring 144 is disposed in the bore 126 and captured between the stem 134 and the firing pin 138. A quasi-helical cam track 146 is provided on the external aft surface of the body 102.

A quasi-helical cam track 148 is provided at the external surface of the aft rotor 24 for its aft and forward dwell portions by a side wall 150 of a rib 152 and a side wall 151 respectively formed on the rotor and for the remainder portion by an aft side wall 153 and a side wall 154 of an insert 156 fixed to the inner wall of the housing. A longitudinal slot 158 is provided in the wall of the aft rotor with longitudinal tracks 160. A slide 162 is disposed in the slot with rails 164 guided by the tracks. The slide 162 has an aft cam follower roller 166 engaged in the aft rotor cam track 148, and a forward cam driver roller 168 engaged in the gun bolt cam track 146.

A recess 170 is provided in the external surface of the aft rotor and has a shoulder 172. A solenoid 174 is fixed to the housing and has an armature 176 which is coupled through a slot to a dog 178 which is pivotally mounted to the interior wall of the housing and is biased towards the rotor by a helical compression spring 180. The dog may be provided as a toggle to reduce the force required of the solenoid.

Figure 3:
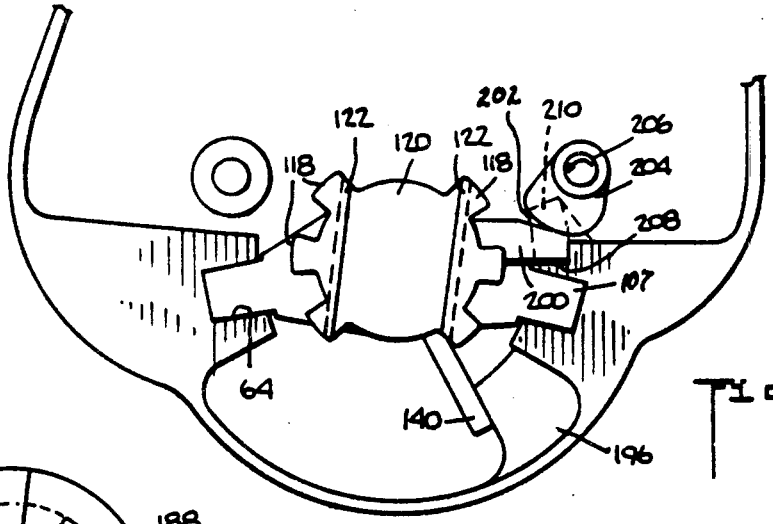
FIG. 3 is a transverse view in cross-section of the embodiment of FIG. 1, taken along plane III—III, looking aft, particularly showing the gun bolt.
Figure 4:
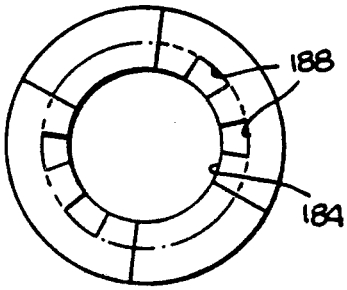
FIG. 4 is a transverse view in cross-section of the embodiment of FIG. 1, taken along plane IV—IV, looking forward, particularly showing the chamber.
Figure 5:
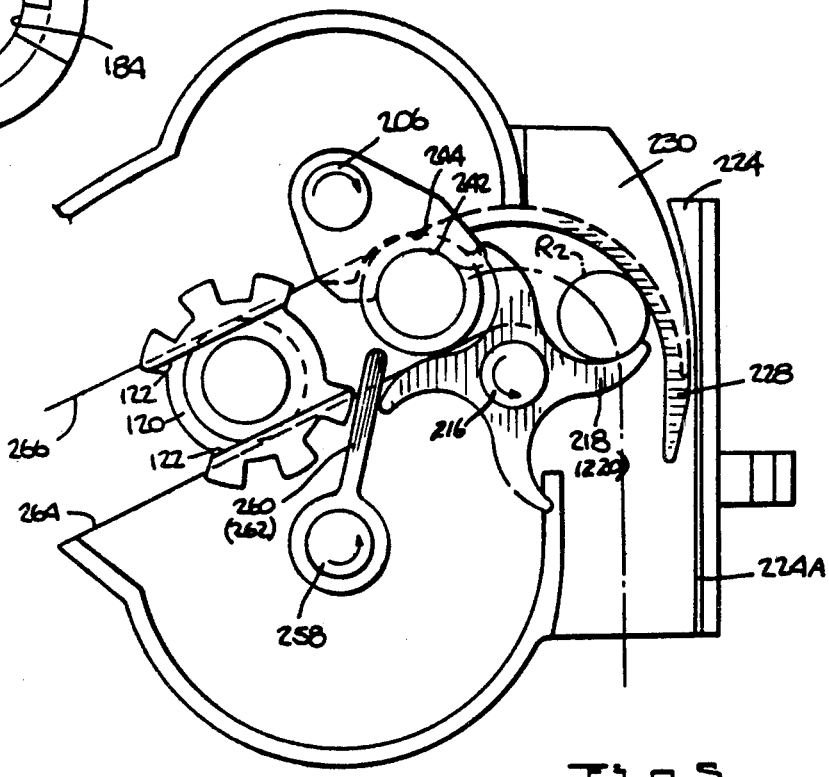
FIG. 5 is a transverse view in cross-section of the embodiment of FIG. 1, taken along plane V—V of FIG. 6, rotated 90°, looking aft, particularly showing the bolt retracted, and the feeder mechanism.

The gun barrel 68 includes the rifled bore 182 and the chamber 184. The barrel extension includes a cavity 186 adapted to receive the bolt head forward portion 116, and a plurality of grooves 188 to pass the locking lugs 118. A post 190 has its aft end fixed to the back plate 22. A helical bolt return spring 192 is disposed over the post 190 and into the bore 114 of the gun bolt, and is captured between the back plate 22 and the disc 132. In the battery, unlocked, disposition of the bolt head, the firing pin actuator arm abuts the aft face 194 of an inwardly directed projection 196 on the housing which serves as a sear, and the firing pin spring is compressed. When the bolt head is rotated fully into its locked disposition, the arm clears the sear, and the firing pin is biased forwardly by the spring. The gun bolt also has a pair of slides 107 extending from the body 102, which also ride in the tracks 64, and an actuating arm 200 extending transversely from the bolt head forward portion 116. The actuating arm 200 has a cam following surface 202 which when in the battery unlocked disposition, as seen in FIG. 3, is acted upon by a counter-clockwise rotating cam 204 which is fixed on a shaft 206 and which rotates one revolution per gun cycle at a nonuniform velocity to swing the arm 200 clockwise into lock. The arm 200 has an additional cam following surface 208 which when in the battery-locked disposition and traveling aft in recoil, is acted upon by a ramp surface 210 on a projection fixed to the housing to swing the arm 200 counter-clockwise into unlock.

The cam tracks 96/98, 146 and 148 do not have uniform pitch angles. To preclude the possibility of a cam roller and a cam track blocking rather than driving, the pitch angle of the cam track should be kept below 51°, and preferably 45°. Given a large enough aft rotor diameter, the pitch angle of the track 146 could be 0°, i.e., a simple annulus. However, with a small diameter aft rotor, to keep down the pitch angle of the track 148, the track 146 is provided with a significant pitch angle. The effective pitch angle of the combination of the tracks 146 and 148 must then be considered with respect to the track 96/98. During the initial portion of the recoil travel of the barrel extension, until the gun bolt is unlocked by the ramp surface 210, the effective pitch angle of the combination of the tracks 146 and 148 must be identical to the pitch angle of the track 96/98. After the gun bolt is unlocked, the effective pitch angle of the combination of the tracks 146 and 148 is made relatively greater than the pitch angle of the track 96/98 to provide for an aftward movement of the gun bolt which is more rapid than the aftward movement of the barrel extension, i.e., acceleration of the gun bolt relative to the barrel extension.

Figure 2:
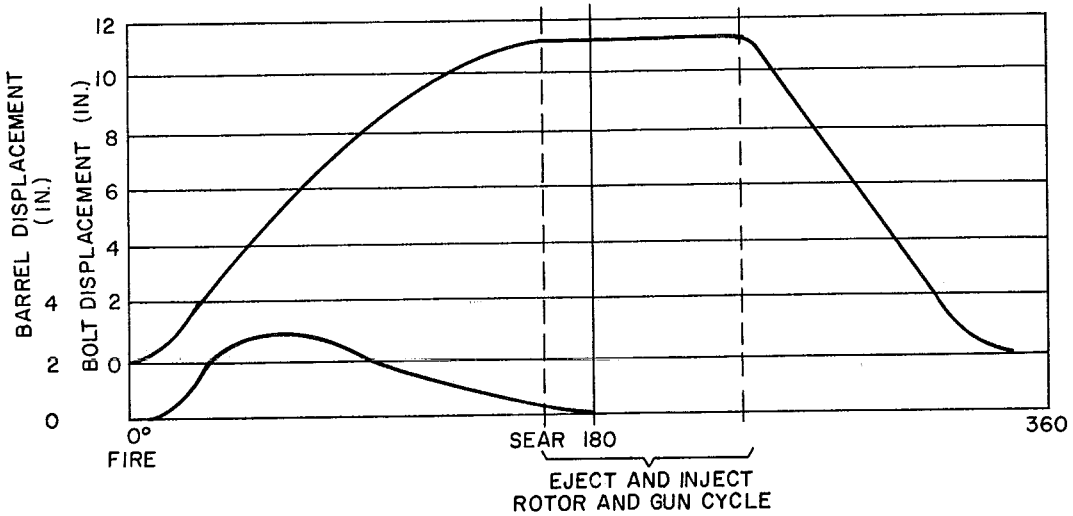
FIG. 2 is a curve showing the relative displacements of the gun barrel and the gun bolt with respect to the cam angle of the rotary operator of the embodiment of FIG. 1.

The gun mechanism as so far described operates as follows: The gun is in battery with a round R1 locked in the chamber as shown in FIG. 1, and the solenoid 174 is energized. As the cam 204 drives the bolt head into its fully locked position, the firing pin actuator arm 140 rides off the sear surface 194 and the spring 144 drives the firing pin 138 to fire the round. The explosion causes the barrel 68 and the barrel extension 60 with the locked thereto gun bolt 74 to recoil aft. As the gun bolt 74 moves aft the cam surface 208 rides up the ramp surface 210, unlocking the bolt head. As the barrel extension moves aft, the cam tracks 96 and 98 drive the cam follower rollers 92 and 94 respectively to rotate the forward rotor 32 and its gear annulus 50. The annulus 50 drives the connecting shaft gear annulus 48, which through the shaft 42 rotates the shaft gear annulus 52, and thereby, the gear annulus 54 and the aft rotor 24. As the aft rotor rotates together with the slide 162, the stationary cam track 148 drives the cam follower roller 166 aft, and thereby, the slide 162 and the cam driver roller 168. The roller 168 drives the gun bolt cam track 146 aft, together with the gun bolt. The slide 162 accelerates the aft movement of the gun bolt with respect to the barrel extension, as shown in FIG. 2. As the barrel and the gun bolt move aft, they respectively compress the barrel return spring 84 and the gun bolt return spring 192. The barrel return spring returns the barrel to battery before 180°. The fired cartridge case is transversely ejected. If another round is to be fired, as the rotors rotate through the gun bolt aft dwell which straddles 180°, while the fired cartridge case is transversely ejected, a fresh cartridge is transversely injected. The gun bolt return spring 192 drives the bolt forward with the fresh cartridge, to insert the bolt head 72 into the aft bore 70 and to chamber the cartridge. The arm 140 abuts the surface 194 compressing the firing pin. The shaft 206 rotates to swing the cam 204 to swing the arm 200 to rotate the bolt head into lock.

If another round is not to be fired, the solenoid 174 is de-energized so that the spring 180 biases the dog 178 to catch the shoulder 172 to halt rotation of the aft rotor. The forward rotor which is coupled to the aft rotor by the connecting shaft 42 continues to rotate but decelerates responsive to its inertia and the torsional strength of the connecting shaft 42, with the barrel extension in battery. The wedging angle of the cam tracks 96 and 98 is such as to prevent reverse movement of the rollers 92 and 94 respectively and reverse rotation of the forward rotor. The system is thus halted in a charged condition with the connecting shaft in torsional strain. Subsequent energization of the solenoid 174 results in an untwisting of the connecting shaft which accelerates the aft rotor, to permit the gun bolt return spring to drive the gun bolt into chamber and be locked.

To charge the gun initially, the forward rotor is rotated by an external source of power, while the rollers 92 and 94 travel in the annular cam track 100.

The feeder injects one round of ammunition between the extractor lugs of the bolt during rear dwell of the gun bolt and ejects the previously fired case. The feeder is driven by the connecting shaft 42 which is driven by the forward rotor 32.

The connecting shaft 42 has a first intermediate gear 201 and a second intermediate sun gear 202. The gear 202 is meshed with a pair of planetary gears 204 which are respectively journalled on a spider 206 and are respectively meshed with a stationary annular gear 208. The spider 206 has an annular sun gear 210 which is meshed with a pair of planetary gears 212 which are respectively journalled on a spider 214 and are respectively meshed with the stationary annular gear 208. This planetary system provides a 16:1 reduction. The spider 214 is integral with a tubular shaft 216 which is coaxial with the connecting shaft 42. A forward stripper sprocket 218 and an aft stripper sprocket 220 are fixed to the shaft 216. The stripper sprockets engage the leading round R2 in a train of linked ammunition, and draws the train past a link positioner 22, forward outer link guides 224, and 224A, aft outer link guides 226, and 226A, a forward stripper guide 228, and an aft stripper guide 230 to strip and eject each link seriation from the respective rounds of ammunition. The stripper sprockets each have four cusps and, rotate at a substantially uniform velocity, one-fourth the rate of the gun.

The gear 201 is meshed with a reduction gear 232, which is fixed for rotation with an elliptical gear 234, which is meshed with an elliptical gear 236, which is fixed for rotation with an idler gear 238, which is meshed with a gear 240 which is fixed to the injector shaft 206. The injector shaft thus rotates at a sinusoidal velocity once per gun cycle. The shaft 206, as previously mentioned carries the cam 204. The shaft 206 has fixed thereto a forward injector sprocket 242 and an aft injector sprocket 244.

The gear 201 is also meshed with an idler gear 246, which is meshed with a gear 248 which is fixed for rotation with an elliptical gear 250, which is meshed with an elliptical gear 252, which is fixed for rotation with a gear 254, which is meshed with a gear 256 which is fixed to an ejector shaft 258. The shaft 258 has fixed thereto a forward retarder-ejector sprocket 260 and an aft retarder-ejector sprocket 262.

In operation, the stripper sprockets rotate counter-clockwise at a substantially uniform velocity to continually pull the train of ammunition at a substantially uniform velocity into the feeder and to strip and eject the leading link. The stripper round is guided on the inner surfaces of the stripper guides 228 and 230, and continuations thereof. The stripper sprockets hand the round off into the cups of the now at substantial dwell injector sprockets 242 and 244 and the round is retained there by the distal ends of the now at substantial dwell retarder-ejector sprockets 260 and 262. When the gun bolt arrives at its rear dwell, the retarder-ejector sprockets rotate counter-clockwise to sweep the fired case laterally across the bolt face out from the extractor lugs 122 and along eject guideways 264 and 266. Concurrently, the injector sprockets rotate clockwise to advance the fresh round along the injector guideway continuations to and across the bolt face and into the extractor lugs 122, and then continue to rotate full cycle to receive the next hand off from the stripper sprockets. The round is prevented from tilting on the bolt face by the trailing edge of the retarder-ejector sprockets, and as the bolt comes forward, these sprockets continue to rotate out of the way and to rotate full cycle to halt the next handed off round in the injector sprockets.

To recapitulate, the sequence of events of the gun cycle may be tabulated as follows:

1. End aft cam front dwell.
2. Start barrel extension-bolt recoil.
3. End pressue build-up.
4. Start pressure decay.
5. Start bolt unlock.
6. End bolt unlock.
7. Barrel extension-bolt separation.
8. End pressure decay.
9. End bolt cam front dwell.
10. End barrel extension recoil—begin counter-recoil.
11. Begin bolt cam rear dwell.

12. Begin rotation of bolt head to feed position.
13. Start feed-ejection cycle.
14. End rotation of bolt head.
15. Begin aft cam rear dwell.
16. Begin counter-rotation of bolt head to normal position.
17. End aft cam rear dwell.
18. End feed ejection cycle.
19. End counter-rotation of bolt head to normal position.
20. End bolt cam rear dwell.
21. End barrel extension counter-recoil—start forward dwell of barrel extension.
22. Begin bolt cam front dwell.
23. Begin cocking firing pin.
24. End cocking firing pin.
25. Begin aft cam forward dwell.
26. Begin rotation of bolt head to lock position.
27. Begin firing pin fall.
28. End rotation of bolt head to lock position.
29. End firing pin fall.
30. Begin primer delay.
31. End primer delay.
32. Start pressure build-up—ignition of power charge.

ALTERNATIVE EMBODIMENT

The invention may be embodied in an externally powered configuration. Conventionally, externally powered configurations have the advantage of continuing to cycle notwithstanding one or more misfires. A rotating source of power, not shown, may be conveniently coupled to the gear annulus of the forward rotor. The pitch angle of the cam tracks 96 and 98 are selected to permit the cam rollers on the forward rotor to reciprocate the barrel extension. The speed of the rotating source of power is selected to drive the gun at a rate which is within the natural, recoil operated, rate of the gun.

ADDITIONAL ALTERNATIVE EMBODIMENT

To insure the maintenance of the disposition of the round of ammunition on the face of the gun bolt the embodiment shown in FIGS. 10A, 10B, 11A, and 11B may be incorporated into the gun bolt. Two longitudinally extending diametrically spaced apart slots 300 and 302 are provided in the head 72, and two z shaped cam slots 304 and 306 are provided in the tubular body 102 which receive respective cam follower pins 308 and 310, which are fixed to respective slides 312 and 314, which are respectively disposed in the slots 304 and 306. In the locked position of the head on the body, shown in FIGS. 10A and 10B, the slides are retracted within the bolt head. In the unlocked position, shown in FIGS. 11A and 11B, the distal ends of the slides project forwardly from the bolt face. The slide 314 is slightly longer than the slide 312. An additional cam, not shown, similar to the cam 204, is fixed to the shaft 206 adjacent the counter-battery position of the bolt head and serves to deflect the arm 200 to swing the bolt head into the locked orientation when the gun bolt is aft, prior to the injection of a fresh round to the face of the bolt. The injector sprockets 242 and 244 then feed a round across the end of the now retracted slide 312 to the center of the bolt face, between the extractor lugs, while the previously fired cartridge case is ejected. An additional ramp surface, not shown, which is the mirror image of the surface 210, is provided slightly forward of the counter-battery position of the bolt head and serves to deflect the arm 200 as the bolt counter-recoils forwardly to swing the bolt head into the unlocked orientation, projecting the ends of the slides from the bolt face. The end of the slide 314 emerges first to positively halt transverse travel of the round along the face of the bolt as the ejector sprockets 260 and 262 swing away from the round. When the bolt is locked into the barrel extension the slides are again retracted. After firing, during recoil, when the bolt is unlocked from the barrel extension the slides are again projected, capturing the fired cartridge case to the bolt face during recoil of the bolt to its counter-battery position.

While there has been shown and described a preferred embodiment of this invention, it will be appreciated that the invention may be embodied otherwise than as herein specifically illustrated or described, and that certain changes in the form and arrangement of parts and in the specific manner of practicing the invention may be made without departing from the underlying idea or principles of this invention within the scope of the appended claims.

What is claimed is:

1. A gun for firing a round of ammunition comprising
a housing;
a gun barrel having a longitudinal axis, disposed within said housing, and journaled for reciprocation along said longitudinal axis with respect to said housing;
a gun bolt disposed within said housing and journaled for reciprocation along said longitudinal axis;
an operating mechanism for said gun bolt comprising
a forward rotating means journaled for rotation about said gun barrel longitudinal axis,
an aft rotating means spaced from said forward rotating means by at least the length of a round of ammunition and journaled for rotation about said gun barrel longitudinal axis,
power transmission means driven by said forward rotating means and driving said aft rotating means,
first coupling means interengaging said gun barrel and said forward rotating means so that rectilinear aftward movement of said gun barrel causes rotation of said aft rotating means, and
second coupling means interengaging said gun bolt and one of said rotating means so that rotation of said one rotating means causes rectilinear aftward movement of said gun bolt;
means for feeding rounds of ammunition to and from said gun bolt; and
third coupling means interengaging said operating means and said feeding means so that said operating means drives said feeding means.

2. A gun comprising
a housing;
a single gun barrel having a longitudinal axis and disposed within said housing;
a single gun bolt disposed within said housing and journaled for reciprocation along said longitudinal axis;
an operating mechanism for said gun bolt journaled for rotation about said longitudinal axis;
means for feeding rounds of ammunition to and from said gun bolt;
coupling means interengaging said operating mechanism and said feeding means; and
said feeding means including first rotating sprocket means, driven at a substantially uniform rotational velocity by said coupling means, for advancing a train of rounds of ammunition at a substantially uniform linear velocity, and second rotating sprocket means, driven at a non-uniform rotational velocity by said coupling means, for receiving a round of ammunition from said first sprocket means and for translating said round to the face of said gun bolt.

3. A gun according to claim 2 wherein:

said feeding means further includes third rotating sprocket means, driven at a non-uniform rotational velocity by said third coupling means for ejecting a previously fired round from the face of said gun bolt.

4. A gun according to claim 3 wherein:

said third rotating sprocket means also serves to preclude translation of round of ammunition to said gun bolt by said second sprocket means until said gun bolt is aft and aligned to receive said round.

* * * * *